US005229737A

United States Patent [19]

Prime

[11] Patent Number: 5,229,737

[45] Date of Patent: Jul. 20, 1993

[54] FERRITE POLARIZER

[75] Inventor: Brian Prime, North Hykeham, United Kingdom

[73] Assignee: Marconi Electronic Devices Limited, Lincoln, England

[21] Appl. No.: 857,573

[22] Filed: Mar. 27, 1992

[30] Foreign Application Priority Data

Apr. 5, 1991 [GB] United Kingdom ..... 9107108
Dec. 10, 1991 [GB] United Kingdom ..... 9126219

[51] Int. Cl.[5] ..... H01P 1/175
[52] U.S. Cl. ..... 333/24.3; 333/24.1
[58] Field of Search ..... 333/24.1, 24.2, 24.3, 333/158

[56] References Cited

U.S. PATENT DOCUMENTS 2,976,280 1/1961 Fraser ..... 333/24.3 X
3,038,131 6/1962 Uebele et al. ..... 333/24.3 X
3,680,010 7/1972 Buck ..... 333/24.1 X
3,681,715 8/1972 Freibergs ..... 333/24.1 X
4,467,292 8/1984 Ajioka et al. ..... 333/24.1

FOREIGN PATENT DOCUMENTS 0237988 9/1987 European Pat. Off. .
1076429 7/1967 United Kingdom .
2222313A 2/1990 United Kingdom .

*Primary Examiner*—Paul Gensler
*Attorney, Agent, or Firm*—Spencer, Frank & Schneider

[57] ABSTRACT

A polariser particularly suitable for use in receiving satellite television signals includes a ferrite rod located within a waveguide, a yoke co-extensive with the ferrite member and a coil wound around the yoke. The yoke preferably is "U" shaped and includes an arm which projects into the waveguide at the end of the ferrite rod remote from the input of the waveguide.

8 Claims, 1 Drawing Sheet

FERRITE POLARIZER

FIELD OF THE INVENTION

This invention relates to polarisers and more particularly, but not exclusively, to those suitable for use in the reception of television signals broadcast from satellites.

BACKGROUND OF THE INVENTION

In one known polariser, a ferrite rod is axially located within a waveguide along which received signals are transmitted. The ferrite rod is surrounded by a bobbin which holds it in position and also acts as a former around which a coil is wound. By controlling the electrical current through the coil, the plane of polarisation of incident energy on the rod can be adjusted and hence the propagation of energy along the waveguide controlled.

The present invention arose from an attempt to provide an improved polariser.

SUMMARY OF THE INVENTION

According to the invention, a polariser arrangement comprises: a ferrite member located within a waveguide; a yoke having a first portion located within the waveguide and a second portion located outside the waveguide with a gap in the magnetic flux path between the ferrite member and yoke; and a coil outside the waveguide wound around the second portion, whereby current applied to the coil affects the polarisation of radiation at the ferrite member.

By employing the invention, energy losses suffered by signals transmitted along the waveguide are reduced as the coil is positioned outside the signal path, unlike in the prior art arrangement. Furthermore, by employing a yoke, the magnetic field produced by the coil is not significantly reduced in effectiveness, even though the coil is remote from the ferrite member. A polariser in accordance with the invention also gives improved cross polarisation compared to the previously known type of polariser, the cross polarisation being a measure of the efficiency of the polariser in changing the plane of polarisation of incoming radiation.

The part of the yoke within the waveguide may be flush with the inner surfaces of the waveguide wall, may be recessed into the wall or may project into the waveguide.

In one preferred embodiment of the invention, the yoke is of a substantially "U" shaped configuration, the ends of its arms being extensive through the waveguide wall. Advantageously, one of the arms projects into the waveguide towards the end of the ferrite member remote from the input of the waveguide. This enhances the cross polarisation of the arrangement.

The arms of the "U" may be normal to the centre part or inclined at angles which are greater or smaller than 90°. The yoke may be configured such that there is no clear distinction between the arms and the center part, being continuously curved.

The yoke is preferably substantially co-extensive with the ferrite member so as to give optimum efficiency but it may be arranged so as to extend over a greater length than the ferrite member or alternatively be smaller than it.

Preferably, the coil is wound on a former located on the yoke, but it may be wound directly on the yoke itself.

BRIEF DESCRIPTION OF THE DRAWINGS

One way in which the invention may be performed is now described by way of example with reference to the accompanying drawings, in which.

DESCRIPTION OF A PREFERRED EMBODIMENT

Figure 1:
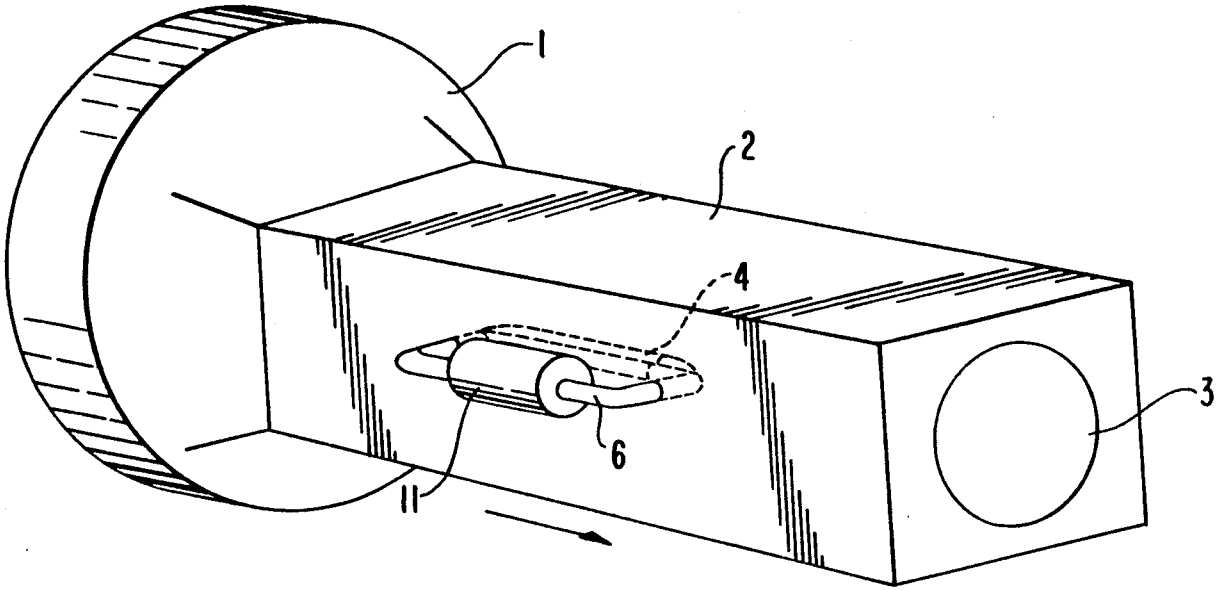
FIG. 1 is a schematic perspective view of an arrangement in accordance with the invention.

With reference to FIG. 1, a satellite television receiver includes a dish antenna (not shown) which receives the transmitted signals and directs them onto a feed arrangement, part of which is shown in the Figure. The signals are transmitted in the direction shown by the arrow passing through a low noise block (LNB) casting 1 and along a waveguide 2 having a cylindrical waveguide bore 3 of approximately 20 mm diameter. The outer surface of the waveguide 2 is of rectangular cross-section as illustrated.

Figure 2:
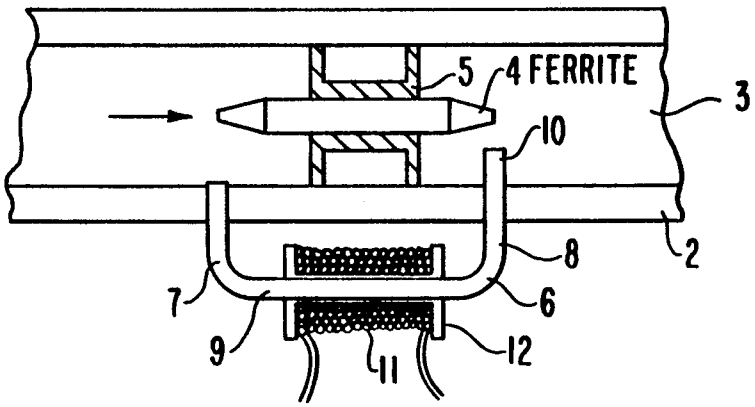
FIG. 2 is a schematic sectional view of the arrangement shown in FIG. 1.

A ferrite rod 4 is located within the waveguide 2, as can be more clearly seen in FIG. 2. The ferrite rod 4 is of square cross-section and has tapered, pyramidal ends. A holder 5 of PTFE surrounds the rod 4 and locates it within the waveguide bore 3.

A U-shaped yoke 6 of mild steel having a circular cross-section has ends 7 and 8 which extend through the wall of the waveguide 2 and a portion 9 which is located outside the waveguide 2. In this embodiment, the portion 9 is generally parallel to the waveguide wall and extensive over substantially the length of the ferrite rod 4. One end 10 of the yoke 6 extends into the waveguide bore 3 a distance of approximately 5 mm towards the tip of the ferrite member 4. The other end of the yoke 6 is substantially flush with the inner surface of the waveguide wall 2.

A coil 11 is wound on a former 12 about the yoke 6 and outside the waveguide 2. When current is passed through the coil 11, the magnetic flux produced is guided by the yoke 6 onto the ferrite rod 4. The extension of the yoke 6 towards the rear of the assembly into the waveguide bore 3 at 10 permits good cross polarisation to be achieved.

I claim:

1. A polariser arrangement comprising:

a ferrite member located within a waveguide, a yoke having a first portion located within the waveguide and a second portion located outside the waveguide with an air gap in a magnetic flux path between the ferrite member and the yoke; and a coil outside the waveguide wound around said second portion, whereby current applied to said coil affects the polarization of radiation of said ferrite member.

2. An arrangement as claimed in claim 1 wherein said yoke is substantially "U" shaped.

3. An arrangement as claimed in claim 2 wherein said yoke comprises a center part substantially parallel with the ferrite member and arms which are extensive through a wall of said waveguide.

4. An arrangement as claimed in claim 3 wherein said coil is wound about said center part of said yoke.

5. An arrangement as claimed in claim 2 wherein said yoke has arms and one of said arms projects into said waveguide towards the end of said ferrite member remote from the input of the waveguide.

6. An arrangement as claimed in claim 1 wherein said waveguide has a longitudinal axis and said yoke is substantially co-extensive with the ferrite member in the direction of the longitudinal axis.

7. An arrangement as claimed in claim 1 and including a former surrounding said yoke, said coil being wound on the former.

8. An arrangement as claimed in claim 1 wherein said yoke is an elongate member of circular transverse section.

* * * * *